US010677447B2

(12) United States Patent
Yu et al.

(10) Patent No.: US 10,677,447 B2
(45) **Date of Patent: *Jun. 9, 2020**

(54) WATERPROOF AND DUSTPROOF DOWNLIGHT

(71) Applicant: XIAMEN ECO LIGHTING CO. LTD., Xiamen (CN)

(72) Inventors: Yuanbin Yu, Xiamen (CN); Jinhua Xie, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/658,992

(22) Filed: Oct. 21, 2019

(65) Prior Publication Data

US 2020/0049340 A1 Feb. 13, 2020

Related U.S. Application Data

(63) Continuation of application No. 15/610,585, filed on May 31, 2017, now Pat. No. 10,488,034.

(30) Foreign Application Priority Data

May 17, 2017 (CN) ..... 2017 1 0347484

(51) Int. Cl.
*F21V 31/00* (2006.01)
*F21V 23/00* (2015.01)
(Continued)

(52) U.S. Cl.
CPC ..... *F21V 31/005* (2013.01); *F21S 8/04* (2013.01); *F21V 3/02* (2013.01); *F21V 7/041* (2013.01);
(Continued)

(58) Field of Classification Search
CPC .. F21S 8/04; F21V 15/01; F21V 17/00; F21V 23/002; F21V 23/009; F21V 23/023;
(Continued)

(56) References Cited

U.S. PATENT DOCUMENTS 3,902,057 A * 8/1975 La Violette ..... B60Q 1/30 362/485
5,045,984 A * 9/1991 Trowbridge ..... F21V 17/164 362/365

(Continued)

*Primary Examiner* — Tsion Tumebo
(74) *Attorney, Agent, or Firm* — Chun-Ming Shih; Lanway IPR Services

(57) ABSTRACT

A waterproof and dustproof downlight has a housing cylinder, a top cover, an upper waterproof casing, a lower waterproof casing and a lighting assembly. The housing cylinder has a cavity with a top opening and a bottom opening. A partition board is mounted in the cavity. The top cover is mounted in the cavity of the housing cylinder. The upper waterproof casing is mounted on a top surface of the partition board and has an upper chamber defined in the upper waterproof casing. The lower waterproof casing is mounted on a bottom surface of the partition board and has a lower chamber defined in the lower waterproof casing a top. The lighting assembly is mounted securely on the bottom surface of the partition board in the lower chamber of the lower waterproof casing. The upper and lower waterproof casings provide excellent dustproof and waterproof functions.

20 Claims, 7 Drawing Sheets

(51) Int. Cl.

| | |
|---|---|
| ***F21V 17/00*** | (2006.01) |
| ***F21V 15/01*** | (2006.01) |
| ***F21V 7/04*** | (2006.01) |
| ***F21S 8/04*** | (2006.01) |
| ***F21V 3/02*** | (2006.01) |
| ***F21Y 115/10*** | (2016.01) |
| ***F21V 23/02*** | (2006.01) |

(52) U.S. Cl.
CPC ..... *F21V 15/01* (2013.01); *F21V 17/00* (2013.01); *F21V 23/002* (2013.01); *F21V 23/009* (2013.01); *F21V 23/023* (2013.01); *F21Y 2115/10* (2016.08)

(58) Field of Classification Search
CPC ..... F21V 31/005; F21V 3/02; F21V 7/041; F21Y 2115/10
See application file for complete search history.

(56) References Cited

U.S. PATENT DOCUMENTS 5,122,944 A * 6/1992 Webb ..... F21V 21/04 362/147
5,927,843 A * 7/1999 Haugaard ..... F21S 8/02 248/220.21
8,220,970 B1 * 7/2012 Khazi ..... F21V 29/004 362/294
8,500,299 B2 * 8/2013 Speidel ..... F21V 11/00 362/235
8,882,311 B2 * 11/2014 Snell ..... F21V 13/04 362/147
9,109,783 B1 * 8/2015 Davis ..... F21S 8/02
9,423,110 B1 * 8/2016 Newton ..... F21S 8/00
10,036,545 B2 * 7/2018 Huang ..... F21V 3/0625
2010/0226139 A1 * 9/2010 Lynch ..... F21S 8/02 362/373
2010/0259919 A1 * 10/2010 Khazi ..... F21V 29/505 362/84
2010/0296272 A1 * 11/2010 Roos ..... F21S 8/026 362/147
2011/0075411 A1 * 3/2011 Van De Ven ..... F21V 15/01 362/235
2011/0222284 A1 * 9/2011 Kong ..... F21S 8/086 362/249.02
2012/0162994 A1 * 6/2012 Wasniewski ..... F21S 8/026 362/294
2013/0141918 A1 * 6/2013 Harbers ..... F21V 29/00 362/294
2013/0294084 A1 * 11/2013 Kathawate ..... F21S 8/026 362/294
2013/0322091 A1 * 12/2013 Honeycutt ..... F21S 8/026 362/319
2015/0276204 A1 * 10/2015 Ray ..... F21S 6/001 239/20
2016/0051351 A1 * 2/2016 Evans ..... A61C 15/043 225/1
2016/0312987 A1 * 10/2016 Danesh ..... F21V 21/14

* cited by examiner

WATERPROOF AND DUSTPROOF DOWNLIGHT

RELATED APPLICATION

The present application is a continued application (CA) of U.S. Filing Ser. No. 15/610,585.

BACKGROUND OF THE INVENTION

1. Field of the Invention

The present invention relates to a downlight, and more particularly to a waterproof and dustproof downlight that complies with Ingress Protection 65 (IP65) level of dustproof and waterproof standard. In other words, the waterproof and dustproof downlight is entirely dustproof and keep external dust from entering the waterproof and dustproof downlight and negatively affecting operation of internal components, and is able to keep low pressure water spray sprayed to the waterproof and dustproof downlight at any angle from disadvantageously affecting the waterproof and dustproof downlight.

2. Description of Related Art

Downlights are commonly used indoor lighting appliances, providing lighting functions or generating specific indoor atmosphere. For example, a downlight of yellow light may provide warm atmosphere.

Later developed downlights in the market have a lighting unit made without tungsten bulb but adopting light emitting diodes (LEDs) with reflector cup and light diffuser board to uniformly diffuse the light radiated from the LEDs. Such downlights have smaller sizes when compared to the conventional downlights with tungsten bulbs and is more power-saving to save money for users.

However, the aforementioned downlights have poor waterproof and dustproof abilities that barely achieve Ingress Protection 44 (IP44) level of dustproof and waterproof standard. In other words, the downlights can only keep particles with a diameter larger than 1 mm from entering but cannot block smaller particles. Also, the downlights can only resist sputtering water instead of low pressure water spray. The smaller particles easily enter and accumulate in the downlight, which disadvantages the heat dissipation of LEDs inside or lower the illumination of the downlight. Furthermore, moisture easily enters the downlight and causes the LEDs to short circuit, which further incurs malfunction of the downlights. Moreover, after the moisture enters downlight, water is accumulated inside and cannot be discharged out of the downlights, which causes the downlight to rust, decreases the lifespan of the downlight and is more likely to cause damages to broken downlights.

To overcome the shortcomings, the present invention provides a waterproof and dustproof downlight to mitigate or obviate the aforementioned problems.

SUMMARY OF THE INVENTION

The main objective of the invention is to provide a waterproof and dustproof downlight that complies with Ingress Protection 65 (IP65) level of dustproof and waterproof standard. In other words, the waterproof and dustproof downlight is entirely dustproof and keep external dust from entering the waterproof and dustproof downlight and negatively affecting operation of internal components, and is able to keep low pressure water spray sprayed to the waterproof and dustproof downlight at any angle from disadvantageously affecting the waterproof and dustproof downlight.

A waterproof and dustproof downlight in accordance with the present invention comprises: a housing cylinder having a cavity having a top opening and a bottom opening; and a partition board mounted horizontally in the cavity; a top cover, mounted in the top opening of the cavity of the housing cylinder; an upper waterproof casing, being hollow, is mounted on a top surface of the partition board and having an upper chamber defined in a bottom of the upper waterproof casing; and an upper waterproof O-ring mounted on an annular periphery of the upper waterproof casing, hermetically contacting the top surface of the partition board and the annular periphery of the bottom of the upper waterproof casing, and sealing the upper chamber; a lower waterproof casing being hollow, mounted a bottom surface of the partition board and having a lower chamber defined in a top of the lower waterproof casing; a lower waterproof O-ring mounted on an annular periphery of a top of the lower waterproof casing, hermetically contacting a bottom surface of the partition board and the annular periphery of the top of the lower waterproof casing, and sealing the lower chamber; and a lower through hole defined in a bottom of the lower waterproof casing and communicating with the lower chamber; a power supplying circuit element mounted in the upper chamber of the upper waterproof casing; and a lighting assembly mounted securely on the bottom surface of the partition board, mounted in the lower chamber of the lower waterproof casing, and electrically connected to the power supplying circuit element.

Another waterproof and dustproof downlight in accordance with the present invention comprises: a housing cylinder having a cavity having a top opening and a bottom opening; and a partition board mounted horizontally in the cavity; a top cover, mounted in the top opening of the cavity of the housing cylinder; an upper waterproof casing, being hollow, is mounted on a top surface of the partition board and having an upper chamber defined in a bottom of the upper waterproof casing; a lower waterproof casing being hollow, mounted a bottom surface of the partition board and having a lower chamber defined in a top of the lower waterproof casing; a lower waterproof O-ring mounted on an annular periphery of a top of the lower waterproof casing, hermetically contacting a bottom surface of the partition board and the annular periphery of the top of the lower waterproof casing, and sealing the lower chamber; and a lower through hole defined in a bottom of the lower waterproof casing and communicating with the lower chamber; a power supplying circuit element mounted in the upper chamber of the upper waterproof casing; and a lighting assembly mounted securely on the bottom surface of the partition board, mounted in the lower chamber of the lower waterproof casing, and electrically connected to the power supplying circuit element.

Another waterproof and dustproof downlight in accordance with the present invention comprises: a housing cylinder having a cavity having a top opening and a bottom opening; and a partition board mounted horizontally in the cavity; a top cover, mounted in the top opening of the cavity of the housing cylinder; an upper waterproof casing, being hollow, is mounted on a top surface of the partition board and having an upper chamber defined in a bottom of the upper waterproof casing; and an upper waterproof O-ring mounted on an annular periphery of the upper waterproof casing, hermetically contacting the top surface of the partition board and the annular periphery of the bottom of the upper waterproof casing, and sealing the upper chamber; a lower waterproof casing being hollow, mounted a bottom surface of the partition board and having a lower chamber defined in a top of the lower waterproof casing; and a lower through hole defined in a bottom of the lower waterproof casing and communicating with the lower chamber; a power supplying circuit element mounted in the upper chamber of the upper waterproof casing; and a lighting assembly mounted securely on the bottom surface of the partition board, mounted in the lower chamber of the lower waterproof casing, and electrically connected to the power supplying circuit element.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
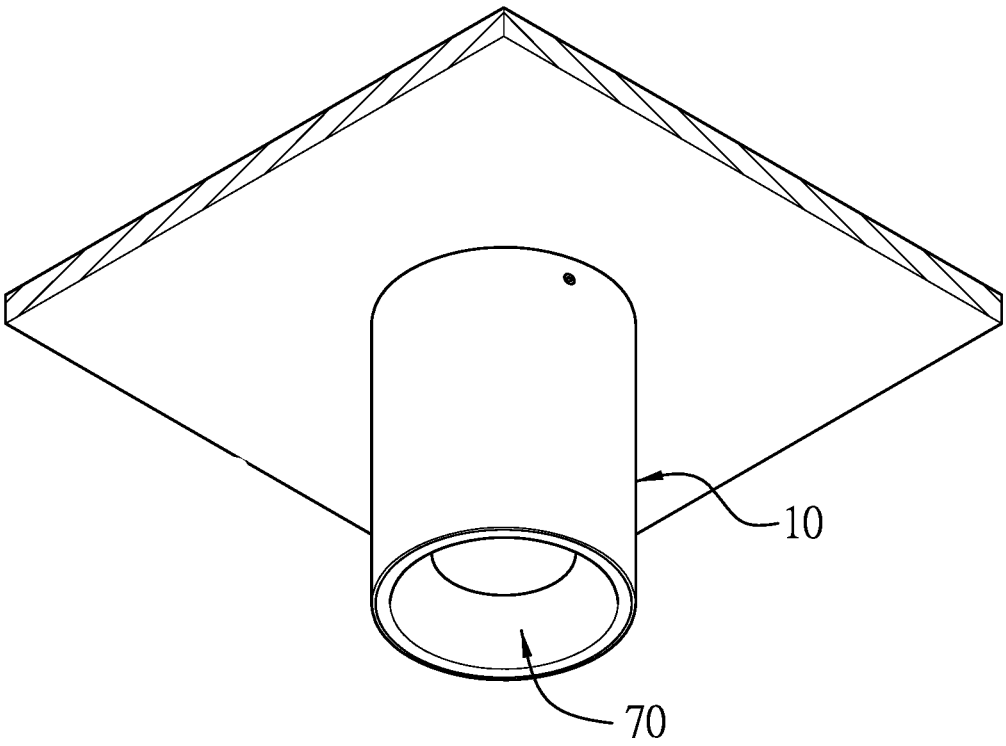
FIG. 1 is a perspective view of a first embodiment of a waterproof and dustproof downlight in accordance with the present invention installed on a ceiling.
Figure 2:
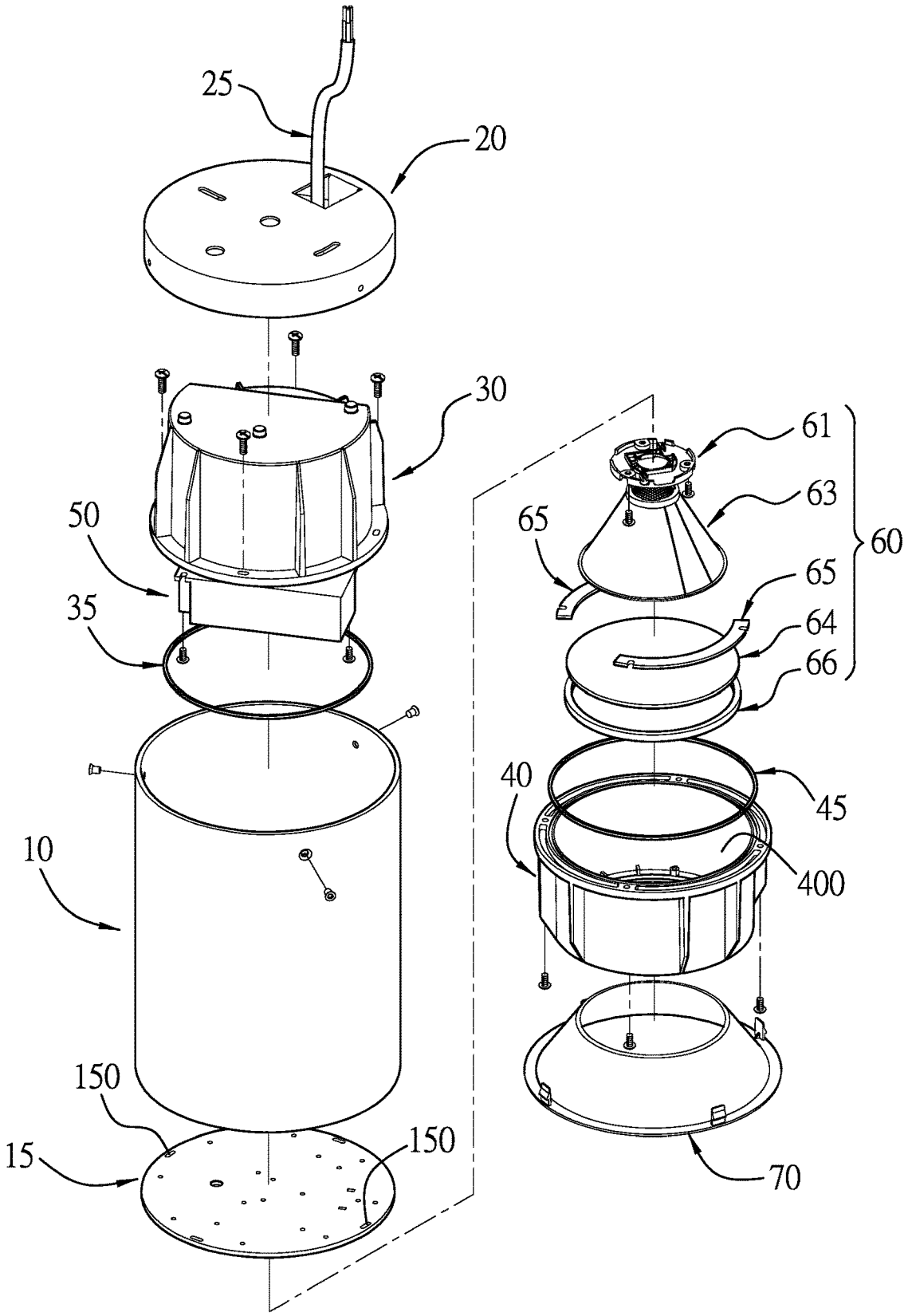
FIG. 2 is an exploded perspective view of the waterproof and dustproof downlight in FIG. 1.
Figure 3:
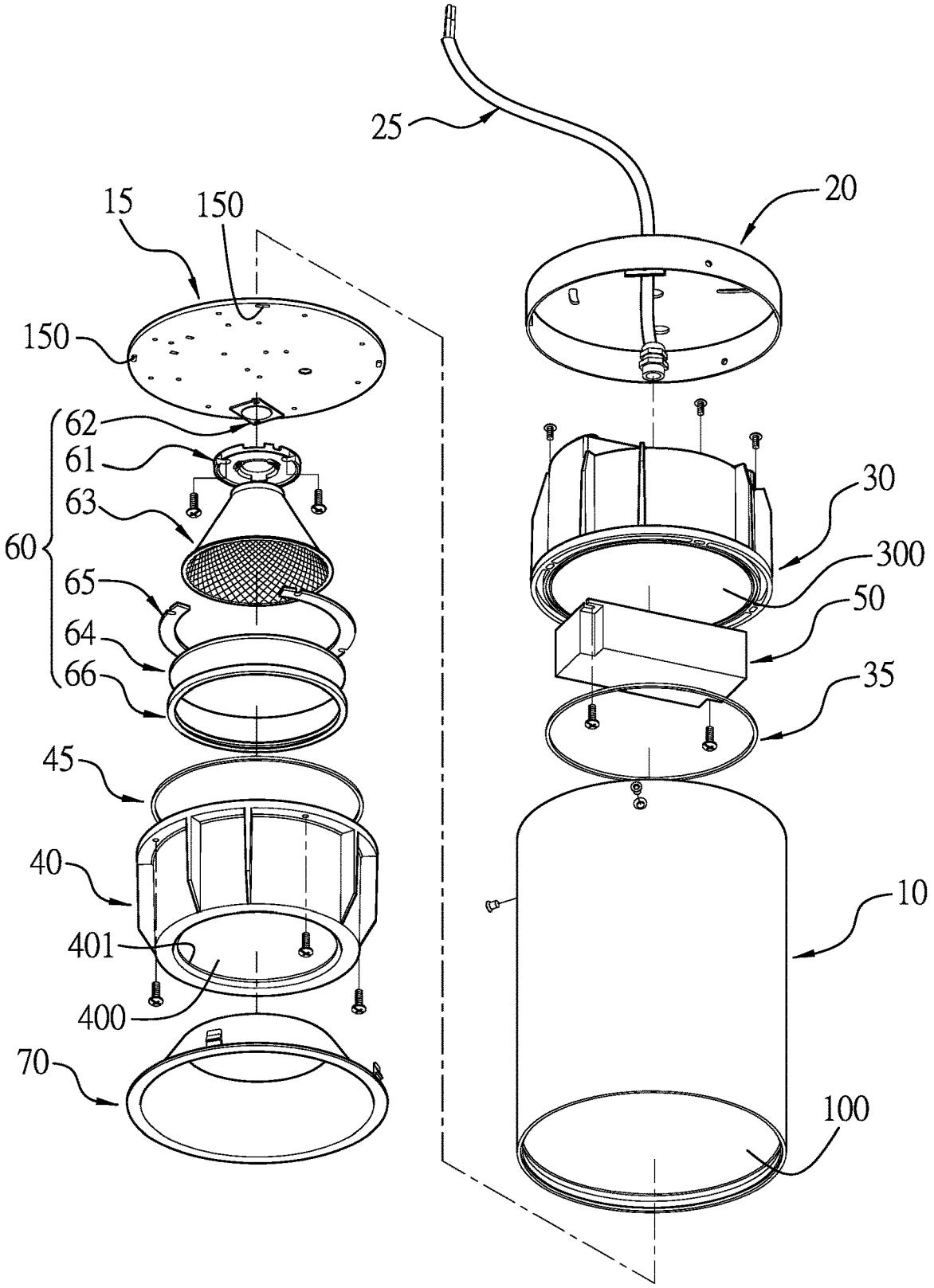
FIG. 3 is another exploded perspective view of the waterproof and dustproof downlight in FIG. 1.

With reference to FIGS. 1 to 3, a first embodiment of a waterproof and dustproof downlight in accordance with the present invention may be installed on a ceiling and comprises: a housing cylinder 10, a top cover 20, an upper waterproof casing 30, a lower waterproof casing 40, a power supplying circuit element 50, a lighting assembly 60 and a reflector rim 70.

The housing cylinder 10 has a cavity 100 and a partition board 15. The cavity 10 is formed in the housing cylinder 10 and has a top opening and a bottom opening. The partition board 15 is mounted horizontally in the cavity 100. The partition board 15 has at least one drain hole 150 defined through an annular outer edge of the partition board 15.

The top cover 20 is mounted in the top opening of the cavity 100 of the housing cylinder 10 and has a power cable 25 that is mounted through the top cover 20.

Figure 4:
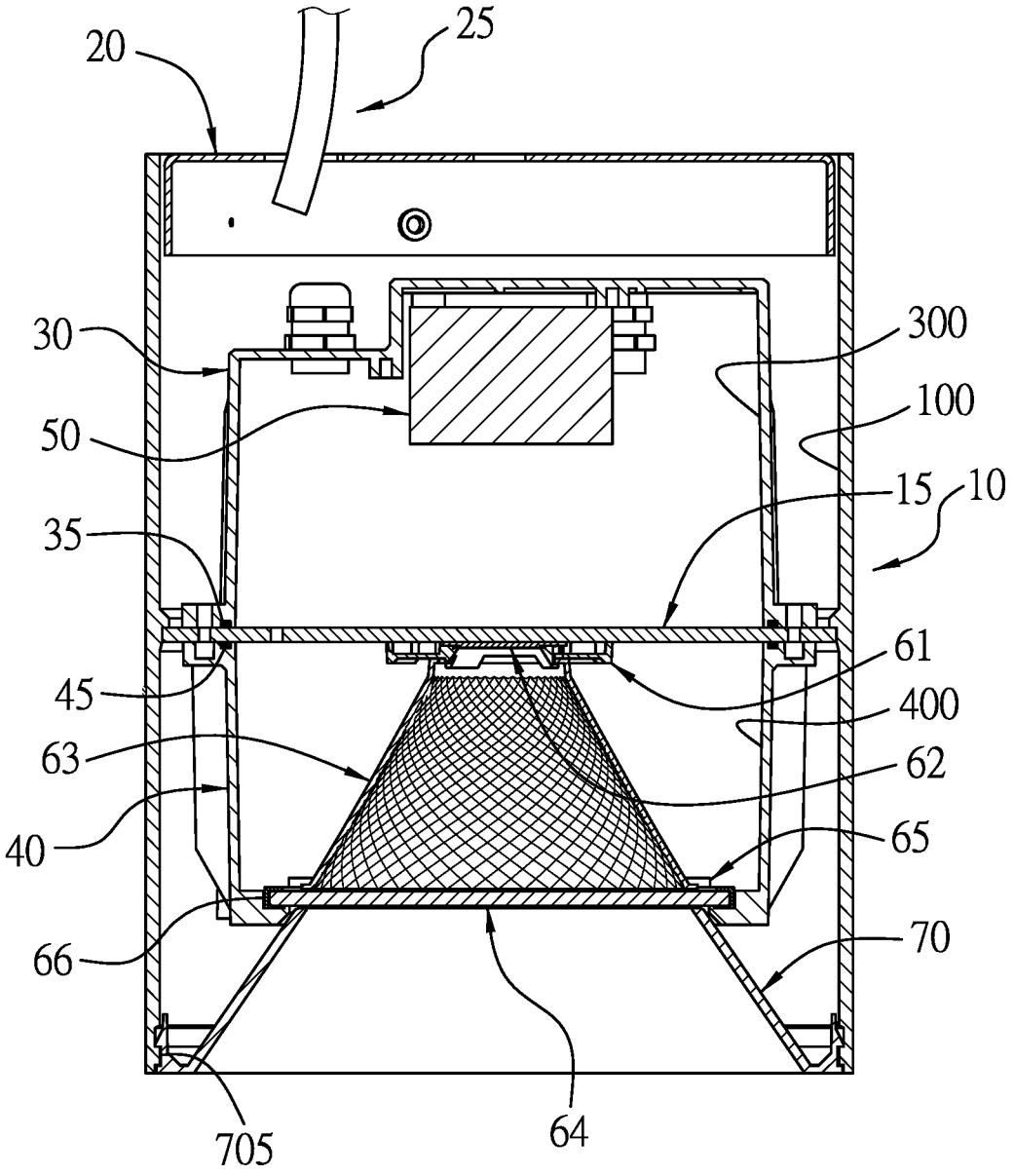
FIG. 4 is a cross sectional side view of the first embodiment of the waterproof and dustproof downlight.

With further reference to FIG. 4, the upper waterproof casing 30 is hollow, is mounted on a top surface of the partition board 15 and has an upper chamber 300 and an upper waterproof O-ring 35. The upper chamber 300 is defined in a bottom of the upper waterproof casing 30. The upper waterproof O-ring 35 is mounted on an annular periphery of the bottom of the upper waterproof casing 30 and may be made of silicone. The upper waterproof O-ring 35 hermetically contacts the top surface of the partition board 15 and an annular periphery of the bottom of the upper waterproof casing 30, and seals the upper chamber 300.

The lower waterproof casing 40 is hollow, is mounted on a bottom surface of the partition board 15 and has a lower chamber 400 and a lower waterproof casing 40. The lower chamber 400 is defined in a top of the lower waterproof casing 40. The lower waterproof O-ring 45 is mounted on an annular periphery of a top of the lower waterproof casing 40 and may be made of silicone. The lower waterproof O-ring 45 hermetically contacts the bottom surface of the partition board 15 and the annular periphery of the top of the lower waterproof casing 40, seals the lower chamber 400 and has a lower through hole 401. The lower through hole 401 is defined in the bottom of the lower waterproof casing 40 and communicates with the lower chamber 400.

The power supplying circuit element 50 is mounted in the upper chamber 300 of the upper waterproof casing 30 and may be a power supply. Furthermore, the power supplying circuit element 50 is connected to the power cable 25.

The lighting assembly 60 is mounted securely on bottom surface of the partition board 15, is mounted in lower chamber 400 of the lower waterproof casing 40, and is connected electrically to the power supplying circuit element 50. The lighting assembly 60 has a lighting unit 62, a connecting collar 61, a reflector cup 63, a light diffuser board 64, at least one mounting element 65, and a mounting ring 66.

The lighting unit 62 is mounted on the bottom surface of the partition board 15 and may be a light-emitting diode module. The connecting collar 61 is mounted on the bottom surface of the partition board 15 and locates the lighting unit 62 between the partition board 15 and the connecting collar 61. The reflector cup 63 is hollow and truncated-cone-shaped, is mounted on the connecting collar 61 and is aligned with the lower through hole 401 of the lower waterproof casing 40. The light diffuser board 64 is mounted on a bottom end of the reflector cup 63. The at least one mounting element 65 is hooked on the bottom end of the reflector cup 63 and is mounted securely on the light diffuser board 64 to combine the reflector cup 63 and the light diffuser board 64. Furthermore, in the first embodiment, a number of the at least one mounting element 65 is two, the two mounting element 65 are semi-ring-shaped and are arranged oppositely at an interval. The mounting ring 66 is mounted around an annular outer periphery of the light diffuser board 64 and presses against an inner annular periphery of the lower through hole 401 of the lower waterproof casing 40.

The reflector rim 70 is hollow and truncated-cone-shaped, is mounted in the bottom opening of cavity 100 of the housing cylinder 10. Furthermore, at least one drain gap 705 is defined between the reflector rim 70 and bottom opening of the cavity 100 of the housing cylinder 10.

Figure 5:
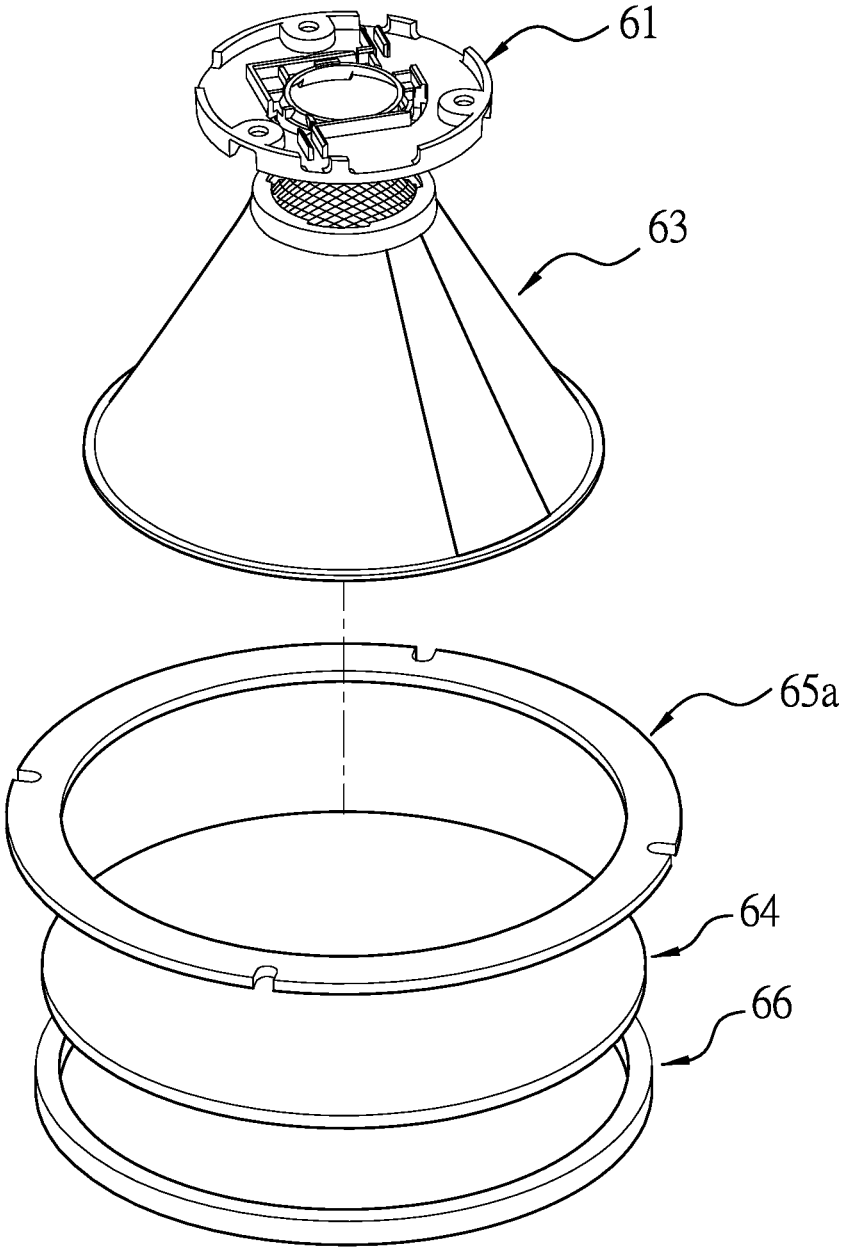
FIG. 5 is an exploded perspective view of a second embodiment of the waterproof and dustproof downlight in accordance with the present invention, wherein the lighting unit is omitted.

With further reference to FIG. 5, a second embodiment of the waterproof and dustproof downlight in accordance with the present invention is similar to the first embodiment and comprises a housing cylinder 10, a top cover 20, an upper waterproof casing 30, a lower waterproof casing 40, a power supplying circuit element 50, a lighting assembly 60 and a reflector rim 70.

The housing cylinder 10 has a cavity 100 and a partition board 15. The cavity 10 is formed in the housing cylinder 10 and has a top opening and a bottom opening. The partition board 15 is mounted horizontally in the cavity 100. The partition board 15 has at least one drain hole 150 defined through an annular outer edge of the partition board 15. The top cover 20 is mounted in the top opening of the cavity 100 of the housing cylinder 10 and has a power cable 25 that is mounted through the top cover 20. The upper waterproof casing 30 is hollow, is mounted on a top surface of the partition board 15 and has an upper chamber 300 and an upper waterproof O-ring 35. The upper chamber 300 is defined in a bottom of the upper waterproof casing 30. The upper waterproof O-ring 35 is mounted on an annular periphery of the bottom of the upper waterproof casing 30 and may be made of silicone. The upper waterproof O-ring 35 hermetically contacts the top surface of the partition board 15 and an annular periphery of the bottom of the upper waterproof casing 30, and seals the upper chamber 300. The lower waterproof casing 40 is hollow, is mounted on a bottom surface of the partition board 15 and has a lower chamber 400 and a lower waterproof casing 40. The lower chamber 400 is defined in a top of the lower waterproof casing 40. The lower waterproof O-ring 45 is mounted on an annular periphery of a top of the lower waterproof casing 40 and may be made of silicone. The lower waterproof O-ring 45 hermetically contacts the bottom surface of the partition board 15 and the annular periphery of the top of the lower waterproof casing 40, seals the lower chamber 400 and has a lower through hole 401. The lower through hole 401 is defined in the bottom of the lower waterproof casing 40 and communicates with the lower chamber 400. The power supplying circuit element 50 is mounted in the upper chamber 300 of the upper waterproof casing 30 and may be a power supply. Furthermore, the power supplying circuit element 50 is connected to the power cable 25. The lighting assembly 60 is mounted securely on bottom surface of the partition board 15, is mounted in lower chamber 400 of the lower waterproof casing 40, and is connected electrically to the power supplying circuit element 50. The lighting assembly 60 has a lighting unit 62, a connecting collar 61, a reflector cup 63, a light diffuser board 64, at least one mounting element 65, and a mounting ring 66. The lighting unit 62 is mounted on the bottom surface of the partition board 15 and may be a light-emitting diode module. The connecting collar 61 is mounted on the bottom surface of the partition board 15 and locates the lighting unit 62 between the partition board 15 and the connecting collar 61. The reflector cup 63 is hollow and truncated-cone-shaped, is mounted on the connecting collar 61, and a bottom of the reflector cup 63 is aligned with the lower through hole 401 of the lower waterproof casing 40. The light diffuser board 64 is mounted on a bottom end of the reflector cup 63. The at least one mounting element 65 is hooked on the bottom end of the reflector cup 63 and is mounted securely on the light diffuser board 64 to combine the reflector cup 63 and the light diffuser board 64. The mounting ring 66 is mounted around an annular outer periphery of the light diffuser board 64 and presses against an inner annular periphery of the lower through hole 401 of the lower waterproof casing 40. The reflector rim 70 is hollow and truncated-cone-shaped, is mounted in the bottom opening of cavity 100 of the housing cylinder 10. Furthermore, at least one drain gap 705 is defined between the reflector rim 70 and bottom opening of the cavity 100 of the housing cylinder 10.

The difference of the second embodiment is that a number of the mounting element 65*a* is one. The mounting element 65*a* is ring-like.

Figure 6:
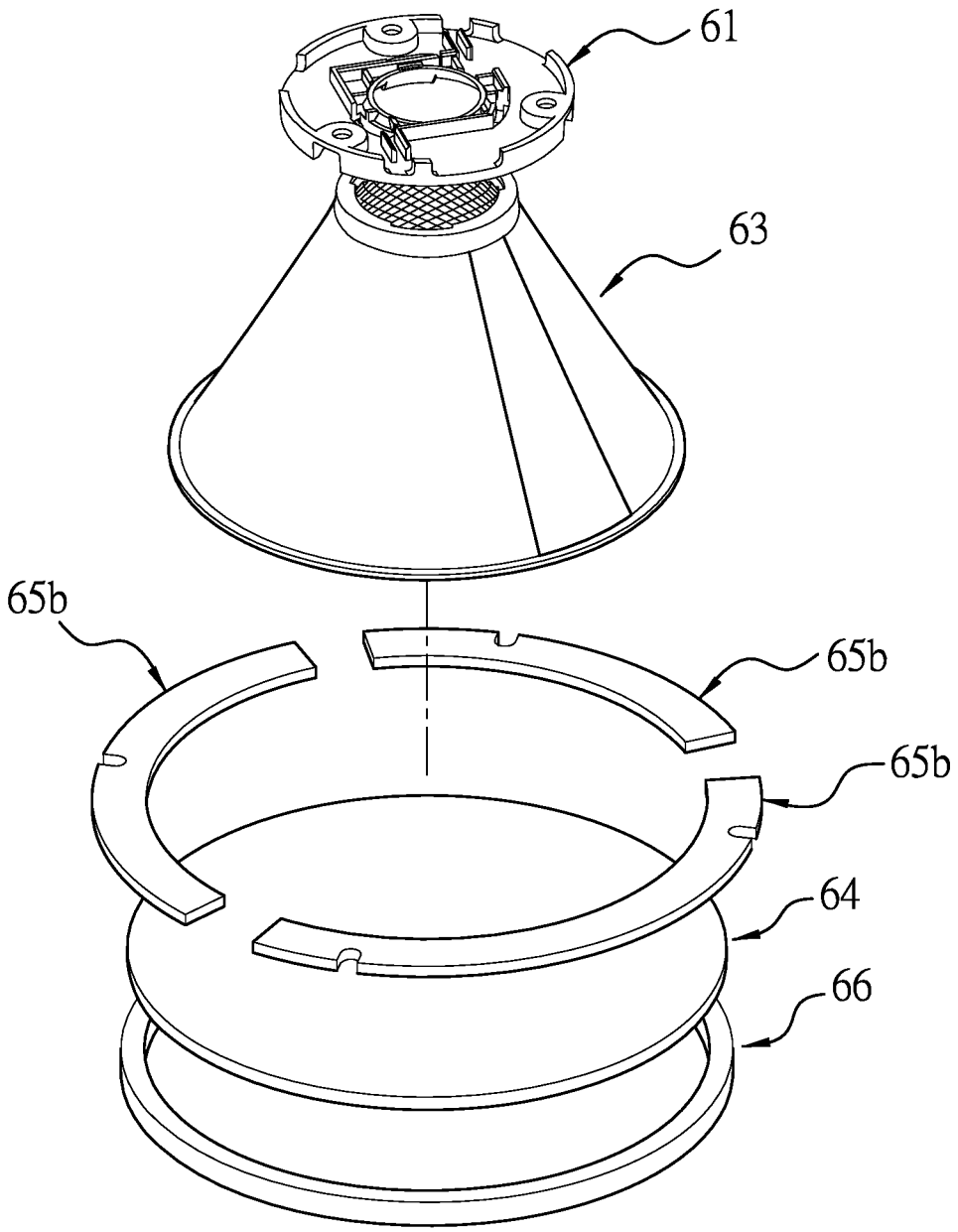
FIG. 6 is an exploded perspective view of a third embodiment of the waterproof and dustproof downlight in accordance with the present invention, wherein the lighting unit is omitted.

With further reference to FIG. 6, a third embodiment of the waterproof and dustproof downlight in accordance with the present invention is similar to the first embodiment and comprises a housing cylinder 10, a top cover 20, an upper waterproof casing 30, a lower waterproof casing 40, a power supplying circuit element 50, a lighting assembly 60 and a reflector rim 70.

The housing cylinder 10 has a cavity 100 and a partition board 15. The cavity 10 is formed in the housing cylinder 10 and has a top opening and a bottom opening. The partition board 15 is mounted horizontally in the cavity 100. The partition board 15 has at least one drain hole 150 defined through an annular outer edge of the partition board 15. The top cover 20 is mounted in the top opening of the cavity 100 of the housing cylinder 10 and has a power cable 25 that is mounted through the top cover 20. The upper waterproof casing 30 is hollow, is mounted on a top surface of the partition board 15 and has an upper chamber 300 and an upper waterproof O-ring 35. The upper chamber 300 is defined in a bottom of the upper waterproof casing 30. The an upper waterproof O-ring 35 is mounted on an annular periphery of the bottom of the upper waterproof casing 30 and may be made of silicone. The upper waterproof O-ring 35 hermetically contacts the top surface of the partition board 15 and an annular periphery of the bottom of the upper waterproof casing 30, and seals the upper chamber 300. The lower waterproof casing 40 is hollow, is mounted on a bottom surface of the partition board 15 and has a lower chamber 400 and a lower waterproof casing 40. The lower chamber 400 is defined in a top of the lower waterproof casing 40. The lower waterproof O-ring 45 is mounted on an annular periphery of a top of the lower waterproof casing 40 and may be made of silicone. The lower waterproof O-ring 45 hermetically contacts the bottom surface of the partition board 15 and the annular periphery of the top of the lower waterproof casing 40, seals the lower chamber 400 and has a lower through hole 401. The lower through hole 401 is defined in a bottom of the lower waterproof casing 40 and communicates with the lower chamber 400. The power supplying circuit element 50 is mounted in the upper chamber 300 of the upper waterproof casing 30 and may be a power supply. Furthermore, the power supplying circuit element 50 is connected to the power cable 25. The lighting assembly 60 is mounted securely on bottom surface of the partition board 15, is mounted in lower chamber 400 of the lower waterproof casing 40, and is connected electrically to the power supplying circuit element 50. The lighting assembly 60 has a lighting unit 62, a connecting collar 61, a reflector cup 63, a light diffuser board 64, at least one mounting element 65, and a mounting ring 66. The lighting unit 62 is mounted on the bottom surface of the partition board 15 and may be a light-emitting diode module. The connecting collar 61 is mounted on the bottom surface of the partition board 15 and locates the lighting unit 62 between the partition board 15 and the connecting collar 61. The reflector cup 63 is hollow and truncated-cone-shaped, is mounted on the connecting collar 61, and a bottom of the reflector cup 63 is aligned with the lower through hole 401 of the lower waterproof casing 40. The light diffuser board 64 is mounted on a bottom end of the reflector cup 63. The at least one mounting element 65 is hooked on the bottom end of the reflector cup 63 and is mounted securely on the light diffuser board 64 to combine the reflector cup 63 and the light diffuser board 64. The mounting ring 66 is mounted around an annular outer periphery of the light diffuser board 64 and presses against an inner annular periphery of the lower through hole 401 of the lower waterproof casing 40. The reflector rim 70 is hollow and truncated-cone-shaped, is mounted in the bottom opening of cavity 100 of the housing cylinder 10. Furthermore, at least one drain gap 705 is defined between the reflector rim 70 and bottom opening of the cavity 100 of the housing cylinder 10.

The difference of the third embodiment is that a number of the mounting element 65*b* is three. The three mounting element 65*b* are one-third ring-like and are arranged at uniform intervals.

Figure 7:
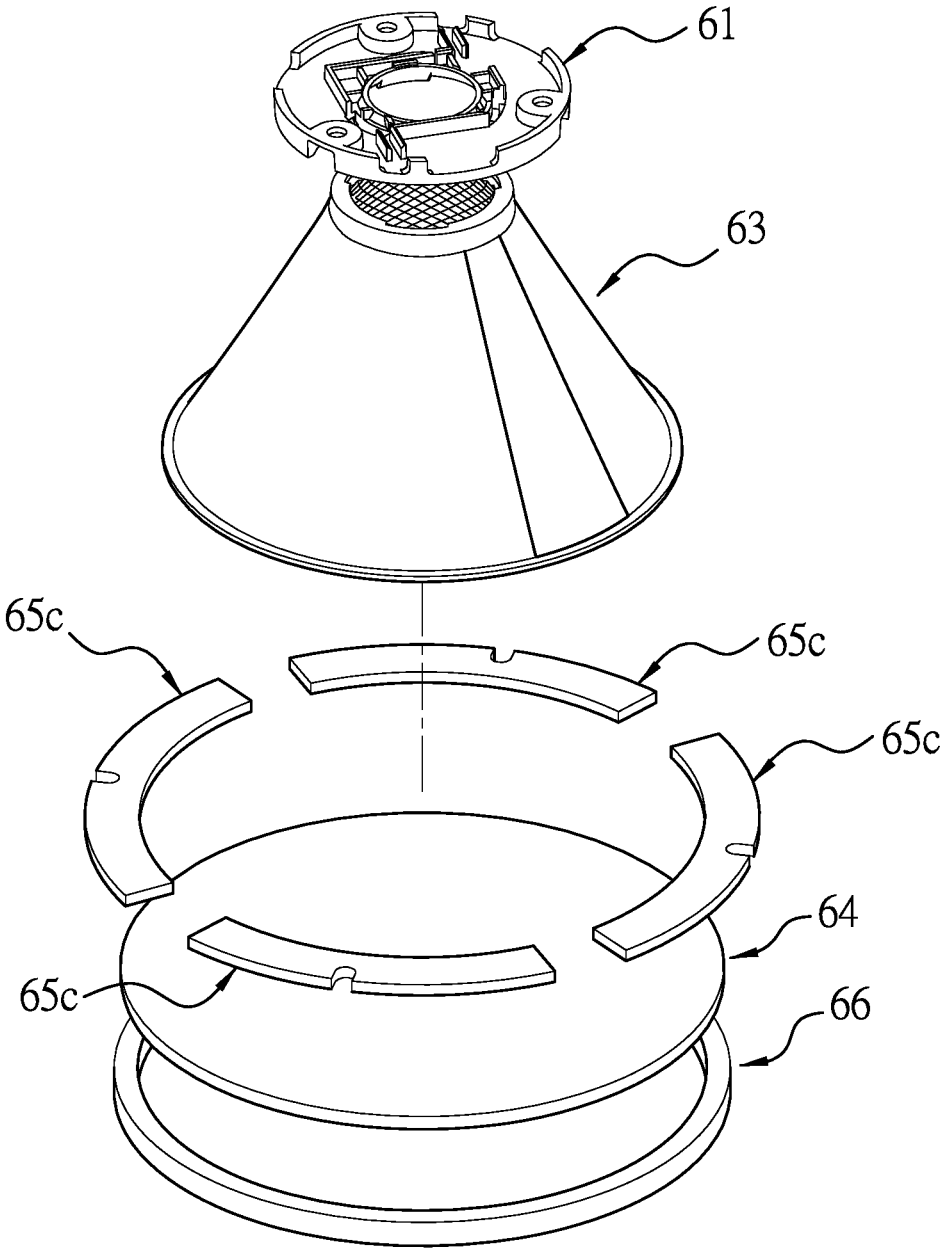
FIG. 7 is an exploded perspective view of a fourth embodiment of the waterproof and dustproof downlight in accordance with the present invention, wherein the lighting unit is omitted.

With further reference to FIG. 7, a fourth embodiment of the waterproof and dustproof downlight in accordance with the present invention is similar to the first embodiment and comprises a housing cylinder 10, a top cover 20, an upper waterproof casing 30, a lower waterproof casing 40, a power supplying circuit element 50, a lighting assembly 60 and a reflector rim 70.

The housing cylinder 10 has a cavity 100 and a partition board 15. The cavity 10 is formed in the housing cylinder 10 and has a top opening and a bottom opening. The partition board 15 is mounted horizontally in the cavity 100. The partition board 15 has at least one drain hole 150 defined through an annular outer edge of the partition board 15. The top cover 20 is mounted in the top opening of the cavity 100 of the housing cylinder 10 and has a power cable 25 that is mounted through the top cover 20. The upper waterproof casing 30 is hollow, is mounted on a top surface of the partition board 15 and has an upper chamber 300 and an upper waterproof O-ring 35. The upper chamber 300 is defined in a bottom of the upper waterproof casing 30. The an upper waterproof O-ring 35 is mounted on an annular periphery of the bottom of the upper waterproof casing 30 and may be made of silicone. The upper waterproof O-ring 35 hermetically contacts the top surface of the partition board 15 and an annular periphery of the bottom of the upper waterproof casing 30, and seals the upper chamber 300. The lower waterproof casing 40 is hollow, is mounted on a bottom surface of the partition board 15 and has a lower chamber 400 and a lower waterproof casing 40. The lower chamber 400 is defined in a top of the lower waterproof casing 40. The lower waterproof O-ring 45 is mounted on an annular periphery of a top of the lower waterproof casing 40 and may be made of silicone. The lower waterproof O-ring 45 hermetically contacts the bottom surface of the partition board 15 and the annular periphery of the top of the lower waterproof casing 40, seals the lower chamber 400 and has a lower through hole 401. The lower through hole 401 is defined in a bottom of the lower waterproof casing 40 and communicates with the lower chamber 400. The power supplying circuit element 50 is mounted in the upper chamber 300 of the upper waterproof casing 30 and may be a power supply. Furthermore, the power supplying circuit element 50 is connected to the power cable 25. The lighting assembly 60 is mounted securely on bottom surface of the partition board 15, is mounted in lower chamber 400 of the lower waterproof casing 40, and is connected electrically to the power supplying circuit element 50. The lighting assembly 60 has a lighting unit 62, a connecting collar 61, a reflector cup 63, a light diffuser board 64, at least one mounting element 65, and a mounting ring 66. The lighting unit 62 is mounted on the bottom surface of the partition board 15 and may be a light-emitting diode module. The connecting collar 61 is mounted on the bottom surface of the partition board 15 and locates the lighting unit 62 between the partition board 15 and the connecting collar 61. The reflector cup 63 is hollow and truncated-cone-shaped, is mounted on the connecting collar 61, and a bottom of the reflector cup 63 is aligned with the lower through hole 401 of the lower waterproof casing 40. The light diffuser board 64 is mounted on a bottom end of the reflector cup 63. The at least one mounting element 65 is hooked on the bottom end of the reflector cup 63 and is mounted securely on the light diffuser board 64 to combine the reflector cup 63 and the light diffuser board 64. The mounting ring 66 is mounted around an annular outer periphery of the light diffuser board 64 and presses against an inner annular periphery of the lower through hole 401 of the lower waterproof casing 40. The reflector rim 70 is hollow and truncated-cone-shaped, is mounted in the bottom opening of cavity 100 of the housing cylinder 10. Furthermore, at least one drain gap 705 is defined between the reflector rim 70 and bottom opening of the cavity 100 of the housing cylinder 10.

The difference of the fourth embodiment is that a number of the mounting element 65*c* is four. The four mounting element 65*c* are quarter-ring-like and are arranged at uniform intervals.

The waterproof and dustproof downlight of the present invention has the following advantages.

1. The upper waterproof casing 30 combined with the upper waterproof O-ring 35 effectively seals the upper chamber 300 of the upper waterproof casing 30 and avoids the power supplying circuit element 50 from short circuit or malfunction due to damages causes by external dust or moisture. Furthermore, the lower waterproof casing 40 combined with the lower waterproof O-ring 45 effectively seals the lower chamber 400 of the lower waterproof casing 40 and keeps the lighting assembly 60 from short circuit or malfunction due to damages causes by external dust or moisture. Therefore, the waterproof and dustproof downlight of the present invention achieves Ingress Protection 65 (IP65) level of dustproof and waterproof standard.

2. The drain hole 150 of the annular outer edge of the partition board 15, and the drain gap 705 between the reflector rim 70 and the bottom opening of the cavity 100 of the housing cylinder 10 allows the waterproof and dustproof downlight to discharge out inside accumulated water. When moisture inadvertently enters the cavity 100 of the housing cylinder 10 through a gap between the housing cylinder 10 and the top cover 20, accumulated water may be flows downward though the drain hole 150 and the drain gap 705 out of the housing cylinder 10. Even the waterproof and dustproof downlight is set reversibly, the accumulated water may be discharged through the drain hole 150, the drain gap 705 out of the gap between the housing cylinder 10 and the top cover 20.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A waterproof downlight comprising:

a housing having a cavity having a top opening and a bottom opening; and a partition board separate from the housing and inserted into the housing and mounted horizontally in the cavity;

a top cover, mounted in the top opening of the cavity of the housing;

an upper waterproof casing, being hollow, being mounted on a top surface of the partition board, and having an upper chamber defined in a bottom of the upper waterproof casing; and an upper waterproof O-ring mounted on an annular periphery of the upper waterproof casing, hermetically contacting the top surface of the partition board and the annular periphery of the bottom of the upper waterproof casing, and sealing the upper chamber;

a lower waterproof casing being hollow, being mounted a bottom surface of the partition board and having a lower chamber defined in a top of the lower waterproof casing;

a lower waterproof O-ring mounted on an annular periphery of a top of the lower waterproof casing, hermetically contacting a bottom surface of the partition board and the annular periphery of the top of the lower waterproof casing, and sealing the lower chamber; and a lower through hole defined in a bottom of the lower waterproof casing and communicating with the lower chamber;

a power supplying circuit element mounted in the upper chamber of the upper waterproof casing; and a lighting assembly mounted securely on the bottom surface of the partition board, mounted in the lower chamber of the lower waterproof casing, and electrically connected to the power supplying circuit element.

2. The waterproof downlight as claimed in claim 1, wherein a power cable is mounted through the top cover, and is connected to the power supplying circuit element.

3. The waterproof downlight as claimed in claim 1, wherein the lighting assembly has a lighting unit mounted on the bottom surface of the partition board;

a connecting collar mounted on the bottom surface of the partition board and locating the lighting unit between the partition board and the connecting collar; and a reflector cup being hollow and truncated-cone-shaped, mounted one connecting collar, and a bottom of the reflector cup aligned with the lower through hole of the lower waterproof casing.

4. The waterproof downlight as claimed in claim 3, wherein the lighting assembly further has a light diffuser board mounted on a bottom end of the reflector cup;

at least one mounting element hooked on the bottom end of the reflector cup and mounted securely on the light diffuser board; and a mounting ring mounted around an annular outer periphery of the light diffuser board and pressing against an inner annular periphery of the lower through hole of the lower waterproof casing.

5. The waterproof downlight as claimed in claim 4, wherein a number of the at least one mounting element is one, and the mounting element is ring-like.

6. The waterproof downlight as claimed in claim 4, wherein a number of the mounting element is two, the two mounting element are semi-ring-shaped are semi-ring-shaped and are arranged oppositely at an interval.

7. The waterproof downlight as claimed in claim 4, wherein a number of the mounting element is three, the three mounting element are one-third ring-like and are arranged at uniform intervals.

8. The waterproof downlight as claimed in claim 4, wherein a number of the mounting element is four, the four mounting element are quarter-ring-like and are arranged at uniform intervals.

9. The waterproof downlight as claimed in claim 1, further having a reflector rim being hollow and truncated-cone-shaped, mounted in the bottom opening of the cavity of the housing.

10. The waterproof downlight as claimed in claim 1, wherein at least one drain hole is defined through an annular outer edge of the partition board.

11. The waterproof downlight as claimed in claim 9, wherein at least one drain gap is defined between the reflector rim and bottom opening of the cavity of the housing.

12. The waterproof downlight as claimed in claim 1, wherein the lighting unit is a light-emitting diode module.

13. The waterproof downlight as claimed in claim 1, wherein the upper waterproof O-ring and lower waterproof O-ring are made of silicone.

14. A waterproof downlight comprising:

a housing having a cavity having a top opening and a bottom opening; and a partition board separate from the housing and inserted into the housing and mounted horizontally in the cavity;

a top cover, mounted in the top opening of the cavity of the housing;

an upper waterproof casing, being hollow, is mounted on a top surface of the partition board and having an upper chamber defined in a bottom of the upper waterproof casing;

a lower waterproof casing being hollow, being mounted a bottom surface of the partition board and having a lower chamber defined in a top of the lower waterproof casing;

a lower waterproof O-ring mounted on an annular periphery of a top of the lower waterproof casing, hermetically contacting a bottom surface of the partition board and the annular periphery of the top of the lower waterproof casing, and sealing the lower chamber; and a lower through hole defined in a bottom of the lower waterproof casing and communicating with the lower chamber;

a power supplying circuit element mounted in the upper chamber of the upper waterproof casing; and a lighting assembly mounted securely on the bottom surface of the partition board, mounted in the lower chamber of the lower waterproof casing, and electrically connected to the power supplying circuit element.

15. The waterproof downlight as claimed in claim 14, wherein a power cable is mounted through the top cover, and is connected to the power supplying circuit element.

16. The waterproof downlight as claimed in claim 14, wherein the lighting assembly has a lighting unit mounted on the bottom surface of the partition board;

a connecting collar mounted on the bottom surface of the partition board and locating the lighting unit between the partition board and the connecting collar; and a reflector cup being hollow and truncated-cone-shaped, mounted one connecting collar, and a bottom of the reflector cup aligned with the lower through hole of the lower waterproof casing.

17. The waterproof downlight as claimed in claim 16, wherein the lighting assembly further has a light diffuser board mounted on a bottom end of the reflector cup;

at least one mounting element hooked on the bottom end of the reflector cup and mounted securely on the light diffuser board; and a mounting ring mounted around an annular outer periphery of the light diffuser board and pressing against an inner annular periphery of the lower through hole of the lower waterproof casing.

18. A waterproof downlight comprising:

a housing having a cavity having a top opening and a bottom opening; and a partition board separate from the housing and inserted into the housing and mounted horizontally in the cavity;

a top cover, mounted in the top opening of the cavity of the housing;

an upper waterproof casing, being hollow, being mounted on a top surface of the partition board and having an upper chamber defined in a bottom of the upper waterproof casing; and an upper waterproof O-ring mounted on an annular periphery of the upper waterproof casing, hermetically contacting the top surface of the partition board and the annular periphery of the bottom of the upper waterproof casing, and sealing the upper chamber;

a lower waterproof casing being hollow, being mounted a bottom surface of the partition board and having a lower chamber defined in a top of the lower waterproof casing; and a lower through hole defined in a bottom of the lower waterproof casing and communicating with the lower chamber;

a power supplying circuit element mounted in the upper chamber of the upper waterproof casing; and a lighting assembly mounted securely on the bottom surface of the partition board, mounted in the lower chamber of the lower waterproof casing, and electrically connected to the power supplying circuit element.

19. The waterproof downlight as claimed in claim 18, wherein a power cable is mounted through the top cover, and is connected to the power supplying circuit element.

20. The waterproof downlight as claimed in claim 18, wherein the lighting assembly has a lighting unit mounted on the bottom surface of the partition board;

a connecting collar mounted on the bottom surface of the partition board and locating the lighting unit between the partition board and the connecting collar; and a reflector cup being hollow and truncated-cone-shaped, mounted one connecting collar, and a bottom of the reflector cup aligned with the lower through hole of the lower waterproof casing.

* * * * *